US006857540B2

(12) United States Patent
Mitchell

(10) Patent No.: US 6,857,540 B2
(45) Date of Patent: Feb. 22, 2005

(54) INTERFOLDED TISSUE SHEET DISPENSER WITH ADJUSTABLE ATTACHING MECHANISM

(75) Inventor: Joseph Mitchell, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 57 days.

(21) Appl. No.: 10/304,987

(22) Filed: Nov. 26, 2002

(65) Prior Publication Data

US 2004/0099680 A1 May 27, 2004

(51) Int. Cl.[7] ..... B65H 1/00
(52) U.S. Cl. ..... 221/45; 221/283
(58) Field of Search ..... 221/45, 282, 283; 222/180; 248/213.2, 224.7, 298.1, 274.1, 311.2

(56) References Cited

U.S. PATENT DOCUMENTS

| | | | |
|---|---|---|---|
| 2,122,048 A | | 6/1938 | Shapiro |
| 2,765,909 A | | 10/1956 | Graham |
| 3,824,953 A | | 7/1974 | Boone |
| 3,836,044 A | | 9/1974 | Tilp et al. |
| 3,837,595 A | | 9/1974 | Boone |
| 3,921,802 A | | 11/1975 | Thompson |
| 3,986,479 A | | 10/1976 | Bonk |
| 3,995,582 A | | 12/1976 | Douglas |
| 4,106,616 A | | 8/1978 | Boone |
| 4,106,617 A | | 8/1978 | Boone |
| 4,235,333 A | | 11/1980 | Boone |
| 4,610,357 A | | 9/1986 | Nakamura |
| 4,620,502 A | | 11/1986 | Kimble |
| 4,638,921 A | | 1/1987 | Sigl et al. |
| 4,651,871 A | | 3/1987 | Schroter |
| 4,653,256 A | | 3/1987 | Saiia |
| 4,739,879 A | | 4/1988 | Nakamura |
| 4,834,316 A | | 5/1989 | DeLorean |
| 4,913,312 A | | 4/1990 | Boutin |
| 5,265,758 A | | 11/1993 | Saint Criq et al. |
| 5,311,986 A | | 5/1994 | Putz |
| 5,409,181 A | | 4/1995 | Patrick |
| 5,439,521 A | | 8/1995 | Rao |
| 5,618,008 A | | 4/1997 | Dearwester et al. |
| 5,660,636 A | | 8/1997 | Shangold et al. |
| 5,765,717 A | | 6/1998 | Gottselig |
| 5,779,205 A | * | 7/1998 | Ching ..... 248/205.8 |
| 5,897,074 A | | 4/1999 | Marino |
| 5,950,960 A | | 9/1999 | Marino |
| 5,951,762 A | | 9/1999 | Shangold et al. |
| 6,047,920 A | | 4/2000 | Dearwester et al. |
| 6,056,235 A | | 5/2000 | Brozinsky |
| 6,098,836 A | | 8/2000 | Gottselig |
| 6,170,698 B1 | | 1/2001 | Phelps et al. |
| 6,230,929 B1 | | 5/2001 | Phelps et al. |
| 6,346,153 B1 | | 2/2002 | Lake et al. |
| 6,382,552 B1 | | 5/2002 | Paul et al. |
| 6,439,386 B1 | | 8/2002 | Sauer et al. |

FOREIGN PATENT DOCUMENTS

| | | |
|---|---|---|
| CA | 2305110 | 10/2001 |
| EP | 1129656 A1 | 9/2001 |

(List continued on next page.)

*Primary Examiner*—David H. Bollinger
(74) *Attorney, Agent, or Firm*—Dority & Manning

(57) ABSTRACT

A dispenser is provided for simultaneously storing and dispensing premoistened tissue sheets and dry tissue sheets. The dispenser includes a housing having a compartment configured to retain a supply of tissue sheets. An adjustable support mechanism is disposed on an exterior surface of the housing sides. The support mechanism engages with a roll product support fixture and is adjustable longitudinally between the back and front of the housing to accommodate fixtures having varying length support arms.

14 Claims, 4 Drawing Sheets

FOREIGN PATENT DOCUMENTS

| | | | |
|---|---|---|---|
| WO | 9414365 | | 7/1994 |
| WO | 9804486 | | 2/1998 |
| WO | 0065973 | A1 | 11/2000 |
| WO | 0153168 | A1 | 7/2001 |
| WO | 0164525 | A2 | 9/2001 |
| WO | 0176436 | A1 | 10/2001 |
| WO | 0176440 | A1 | 10/2001 |
| WO | 0189935 | A2 | 11/2001 |
| WO | 0221988 | A1 | 3/2002 |
| WO | 0221989 | A2 | 3/2002 |

* cited by examiner

INTERFOLDED TISSUE SHEET DISPENSER WITH ADJUSTABLE ATTACHING MECHANISM

TECHNICAL FIELD

The present invention relates generally to the filed of folded sheet dispensers.

BACKGROUND

The utilization and dispensing of toilet tissue in roll form is well known in the art. Typical dispensers for tissue rolls generally include a base that is attached to a wall or other supporting surface, and support arms that extend transversely from the base. A spindle is inserted through the roll and engaged in recesses or divots at the ends of the support arms. Unfortunately, the roll configuration lends itself to excessive use and waste of the tissue product. Consumers tend to unroll far more tissue than is necessary. It has generally been recognized to be more economical to dispense toilet tissue individually in sheets in a manner similar to dispensing of facial tissues.

Numerous dispensers have been developed in the art specifically for dispensing stacked individual tissue sheets. Such dispensers typically permit the user to remove any number of sheets one at a time in a manner such that the adjacent sheet is presented for easy grasping and removal from the dispenser. Efforts have been made to incorporate such dispensers with existing conventional rolled product dispensing fixtures so that the dispenser need not be separately mounted. Space for mounting additional fixtures is often not available in residential and commercial restrooms, and the like. Reference is made for example to U.S. Pat. No. 4,913,312 which describes a dispensing container for stacked individual sheets of tissue having a mounting mechanism on the sides of the container designed to engage with arms of conventional roll product fixtures. Certain embodiments of the mounting mechanisms described in the '312 patent are adjustable to account for variations in the design and configuration of the roll product fixtures.

Various premoistened tissue dispenser designs have also been proposed for use with existing bathroom roll product fixtures. For example, reference is made to U.S. Pat. Nos. 5,439,521; 5,897,074; 6,056,235, and WO 01/89935. Such dispensers are designed to convert or adapt the premoistened tissue sheet dispenser to operate with the dry rolled tissue dispenser fixture.

The present invention provides an alternative improved folded tissue sheet dispenser adapted for configuration with conventional roll product dispensing fixtures.

SUMMARY

Objects and advantages of the invention will be set forth in part in the following description, or may be obvious from the description, or may be learned through practice of the invention.

The present invention provides a unique dispenser configured for dispensing a supply of folded tissues from a dispenser fixture that has extending support arms. The fixture may be, for example, a conventional tissue roll dispenser wherein the support arms include a recess or divot defined at the ends thereof into which the ends of a spindle are received. The spindle is typically inserted through a core or hollow member provided in the bathroom tissue roll.

The dispenser includes a housing having an internal compartment configured to retain a supply of folded issue sheets. It should be appreciated that the housing is not limited to any particular style, configuration, or shape, and may take on any aesthetically pleasing configuration and be made of any conventional material. In one embodiment, the housing is an elongated box-like structure. The housing may be refillable, or can be a disposable item to be discarded after depletion of the tissue supply. It should also be appreciated that the dispenser according to the invention is not limited to any particular type of product to be dispensed, but is particularly well suited for dispensing a stack of interfolded tissue sheets. The tissue sheets may be dry or pre-moistened.

A dispensing opening is defined in a wall of the housing. The opening may be, for example, in a top surface, bottom surface, or side surface of the housing. The opening provides a location for a consumer to easily grasp and pull individual tissue sheets from the dispenser.

An adjustable support mechanism is disposed on opposite exterior side walls of the housing. Each support mechanism includes a protrusion with a shape and configuration for engagement within a recess or divot in the fixture support arms. The protrusions are adjustable in position along their respective side wall between a front and back of the dispenser such that the housing is adaptable with different fixtures having varying length support arms. In one particular embodiment, the support mechanism includes a position arm or bar member extending longitudinally in a direction between the front and a back of the housing. A slide member is variably positionable along the position bar, the protrusions being provided on the slide member. A releasable engagement is defined between the slide member and position bar. For example, the bar may include a plurality of retaining members disposed therealong, such as a row of ridges, that are releasably engaged by an extension member on the slide member. The extension member may be resiliently biased towards the ridges. Any configuration of engaging members operatively disposed between the slide member and position bar may be used. In an alternate embodiment, the slide member may be frictionally retained in position relative to the position bar.

It may also be desired that the protrusions also be adjustable towards and away from the housing side walls to account for dispenser fixtures having varying widths between their respective support arms. For example, the protrusions may be resiliently biased outwardly from the side walls. In the embodiment wherein the protrusions are provided on the slide member that is movable along a position bar, the position bar may be flexible and angled away from the side wall. The position bar may be, for example, a spring arm.

The dispenser may also include a supply of folded tissues disposed within the housing. The housing may be openable and refillable with a cartridge of tissues in the form of, for example, a bag or pouch-like container insertable into the housing.

Aspects of the invention will be described in greater detail below by reference to embodiments illustrated in the figures.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION

Figure 1:
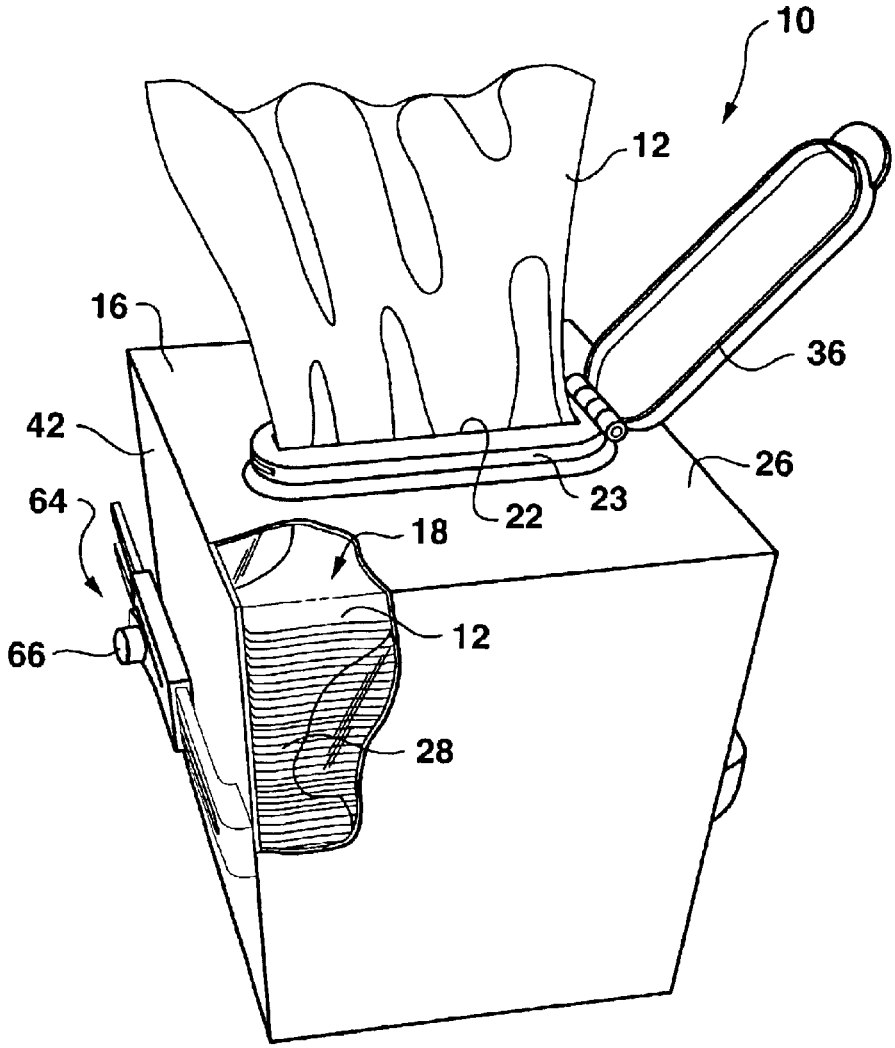
FIG. 1 is a perspective drawing of a dispenser in accordance with the invention with sections of the dispenser shown in partial cut-away.

Reference will now be made in detail to one or more embodiments of the invention, examples of which are illustrated in the drawings. Each example and embodiment are provided by way of explanation of the invention, and not meant as a limitation of the invention. For example, features illustrated or described as part of one embodiment may be used with another embodiment to yield still a further embodiment. It is intended that the invention include these and other modifications and variations as come within the scope and spirit of the invention.

Referring to the figures in general, a dispenser according to the invention is provided for storing and dispensing folded tissue sheets from a fixture having extending support arms, such as a roll product dispensing fixture. It should be appreciated that the invention is not limited to any particular type of tissue sheets, and is suitable for dispensing dry or premoistened tissues. The dispenser according to the invention is particularly well suited for dispensing individual stacked interfolded sheets, as generally illustrated in the figures. Such stacked configurations for dry or premoistened sheets are well known to those of ordinary skill in the art and need not be described in great detail herein.

A dispenser 10 according to the invention is provided for dispensing premoistened tissue sheets 12 and dry tissue sheets 14 from a housing unit 16. The housing 16 includes a compartment 18 in which the tissue sheets 12 are stored and dispensed from. It should be appreciated by those skilled in the art that the housing may take on any shape or configuration, and that the rectangular type configuration illustrated in the figures is for illustrative purposes only. A dispensing opening 22 is defined in the tissue sheet compartment 18. The dispensing opening may be defined in any wall structure of the respective compartment. For example, in the illustrated embodiment, the dispensing opening 22 in the compartment 18 is defined in a top surface or wall 26. It should also be appreciated that the dispensing opening 22 may take on any suitable shape or configuration.

A support mechanism is disposed on each exterior surface of the housing side walls 42. In the illustrated embodiment, the support mechanism 64 includes a protruding member 66 positioned relative to opposite side walls 42 of the dispenser housing 16. The support mechanism 64 is described in greater detail below.

Figure 2:
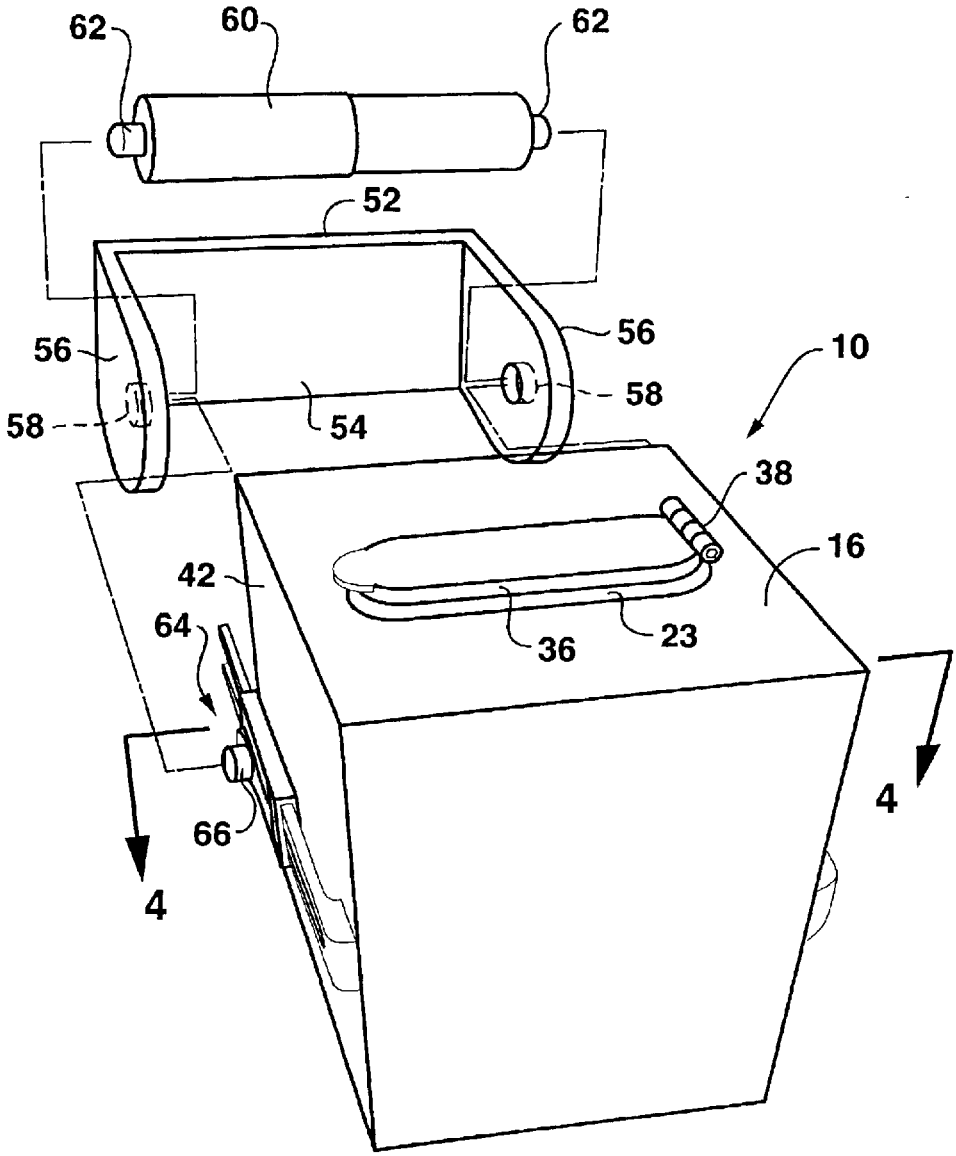
FIG. 2 is a perspective view of a dispenser in accordance with the invention particularly illustrating engagement of the dispenser with a conventional rolled product fixture.

Referring particularly to FIG. 2, the housing 16 has a configuration with a width and a depth so as to be supported by a conventional roll product fixture. Such fixtures are well known and a typical fixture 52 is illustrated in FIG. 2 as having a base or back member 54 and transversely extending side support arms 56. Each of the support arms 56 typically includes a recess or divot 58 formed therein. A conventional spindle 60 having protruding members 62 on each end is typically inserted through a hollow core of a roll product and received in the recesses 58. As indicated by the dashed lines in FIG. 2, the dispenser 10 according to the invention in one particular embodiment is designed to be engaged by such typical fixture 52 utilized for rolled products. The support mechanism 64 on each of the side walls 42 of the dispenser housing 16 includes the protruding member 66, which may be a spring loaded member, that engages in a respective recess 58 in the fixture side arm 56. Once the protruding members 66 are engaged within the recesses 58, the dispenser 10 is prevented from rotating or pivoting by the fact that the back wall of the dispenser 10 abuts against the base 54 of the fixture 52.

The housing 16 may be formed of any conventional material, and may be a relatively inexpensive plastic disposable material, paperboard material, paper, cardboard, and the like. It may be desired to form the housing 16 of a liquid impermeable material if it is desired to contain and dispense premoistened tissue sheets 12. Alternatively, the housing 16 may be formed of any type of material, including a liquid absorbent, and the premoistened tissue sheets 12 may be encased in a liquid impermeable film 28. Alternatively, the compartment 18 may be lined with the film 28. The premoistened tissue sheets 12 may be provided in a refill package or cartridge that may be placed into the compartment 18, the refill package including the liquid impermeable film 28. In this configuration, the compartment would have a resealable wall, lid, or other member that may be opened to allow a refill cartridge of tissues to be inserted into the respective compartment.

It may further be desired that the premoistened tissue sheet compartment 18 include a resealable cover 36 disposed over the dispensing opening 22. In the case of premoistened sheets, the cover 36 may be hinged with hinge 38 and serves to maintain the moisture conditions within the compartment 18 and prevents undesired drying out of the tissue sheets 12. In an illustrated embodiment, the lid 36 is simply frictionally engaged with a rim 23 disposed around the dispensing opening 22. Such closure members are well known from their use with conventional premoistened wipe containers.

Figure 3:
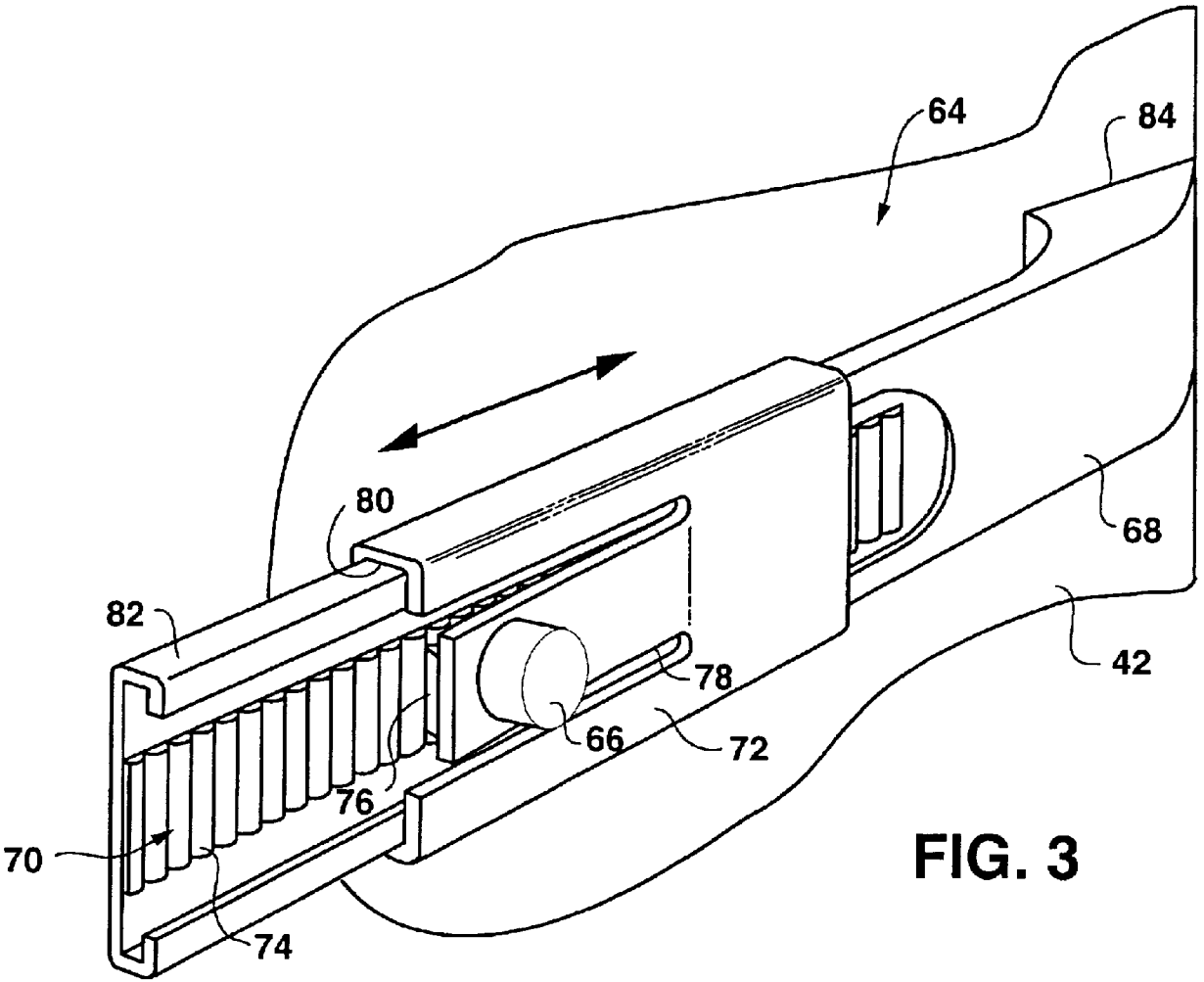
FIG. 3 is a perspective view of an embodiment of a support mechanism in accordance with the invention.
Figure 4:
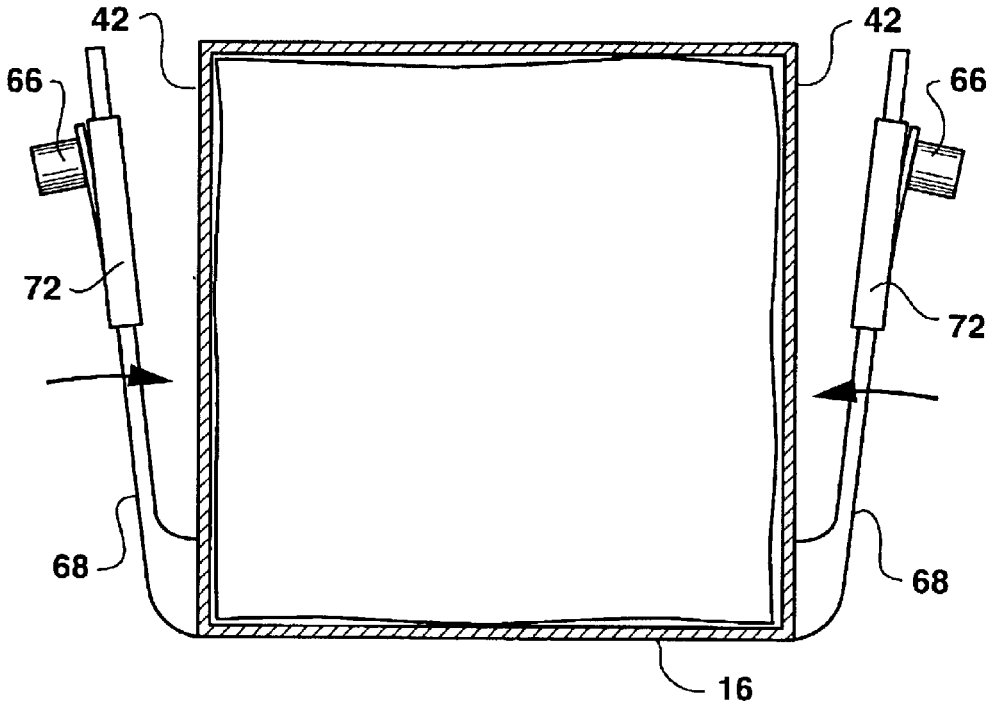
FIG. 4 is a perspective cut-away view of the dispenser shown in FIG. 2 taken along the lines indicated.

An embodiment of a support mechanism 64 in accordance with the invention is illustrated in greater detail in FIGS. 3 and 4. The support mechanism structure 64 is provided on the opposite side walls 42 of the dispenser housing 16. Each support mechanism 64 is configured so that the protrusions 66 are variably positionable relative to the housing side walls 42 between the back and front of the dispenser housing 16. In this regard, the dispenser 10 may be configured with different types of roll product fixtures having varying length arms.

Referring to FIG. 3, in one particular embodiment of the support mechanism 64, a longitudinally extending position bar or member 68 is configured on the side wall 42 of the housing 16. The position bar 68 includes a plurality of retaining members defined along at least a portion of the longitudinal length thereof. In the illustrated embodiment, the retaining members 70 are defined by adjacent ridges 74 defined on an outward face of the position bar 68. In alternate embodiments, the retaining members may include any configuration of male or female structures, such as divots, recesses, lugs, posts, etc.

The support mechanism 64 also includes a slide member 72 that is slidably configured on the position bar 68. In the illustrated embodiment, the slide member 72 is an elongated hollow member having side channels 80 that slide on rail structures 82 defined on the position bar 68. The slide member 72 includes an extension member 76 that releasably engages with the retaining members 70 defined on the position bar 68. For example, in the illustrated embodiment, the extension member 76 comprises an inwardly directed ridge or member defined at the end of a resilient tab 78. The resilient tab 78 biases the extension member 76 between the ridges 74. It should be appreciated that any configuration of releasably engaging structure, such as engaging male/female structure, may be used to releasably engage the slide member 72 with the position bar 68. In an alternate embodiment, the slide member 72 may be frictionally engaged with the position bar.

The protrusion 66 that is configured to engage within the recess of the fixture support arms, may be defined at the end of the resilient tab 78, as illustrated in FIG. 3. In order to release the slide member 72 and reposition the slide member along the position bar 68, it is merely necessary to pull the protrusion 66 outwardly so that the extension member 76 disengages from the ridges 74. The slide member 72 is then repositioned to a desired position and the protrusion 66 is released.

It may also be desired to provide a degree of adjustability to the protrusion 66 that is generally transverse to the plane of the side walls 42. In this manner, the dispenser 10 may be configured with fixtures having a varying width or distance between the support arms. Various configurations may be used to provide the protrusions with such transverse adjustability. For example, in the illustrated embodiment, the position bar 68 is a resilient member that is angled away from the side walls 42, as particularly illustrated in FIG. 4. The position bar 68 may be adhered or otherwise connected to the side wall 42 at an interface 84 with the remaining longitudinal portion of the position bar extending at an angle away from the side wall 42. The position bar 68 is thus resiliently mounted and is resiliently movable towards the side wall 42, as indicated by the arrows in FIG. 4. Referring to FIG. 2, in order to engage the dispenser 10 with the support arms 56, the flexible position arms 68 are merely pressed inward towards the housing side walls 42 to position the dispenser 10 between the support arms 56. Once the dispenser is properly positioned, the position bars 68 may be released.

It should be appreciated that it is not a requirement of the invention that the slide bars 68 be angled or resiliently biased in order to provide the protrusion 66 with a degree of outward or laterally adjustability. For example, the slide bar 68 may be mounted directly against the housing side walls 42 and the protrusions 66 may be spring biased relative to the slide bars 68. In an alternate embodiment, the protrusions 66 may be defined by telescoping members. It should be apparent that various configurations are possible in this regard.

It should be readily apparent to those skilled in the art that modifications and variations can be made to the embodiments of the dispenser described herein without departing from the scope and spirit of the invention as set forth in the appended claims.

What is claimed is:

1. A dispenser for storing and dispensing folded tissue sheets, said dispenser adapted for configuration with a roll product dispensing fixture having support arms and spindle recesses defined at ends of the support arms, said dispenser comprising:

a housing having an internal compartment configured to retain a supply of folded issue sheets;

a dispensing opening defined in a wall of said housing:

an adjustable support mechanism disposed on opposite exterior side walls of said housing, each said support mechanism comprising a protrusion with a shape and configuration for engagement with the spindle recesses in the fixture support arms; and wherein said protrusions are adjustable in position along a longitudinally extending component of said respective support mechanism between a front and a back of said housing such that said housing is adaptable with fixtures having varying length support arms.

2. The dispenser as in claim 1, wherein said housing comprises a generally elongated box-like structure having parallel side walls, said protrusions extending outwardly relative to said side walls.

3. The dispenser as in claim 1, wherein said support mechanism comprises a position bar extending longitudinally in a direction between the front and back of said housing, said bar having a plurality of retaining members disposed therealong, said support mechanism further comprising a slide member slidably disposed on said position bar, said protrusion configured on said slide member.

4. The dispenser as in claim 3, wherein said retaining members comprise spaced apart ridges, said slide member comprising an extension member releasably engageable between said ridges.

5. The dispenser as in claim 4, wherein said extension member is resiliently biased towards said ridges.

6. The dispenser as in claim 1, wherein said protrusions are also resiliently biased outwardly from said side walls.

7. The dispenser as in claim 6, wherein said protrusions are configured on a resiliently disposed position bar, said bar outwardly flexible relative to said side wall.

8. The dispenser as in claim 1, further comprising a supply of folded tissues disposed within said housing, said housing being refillable and openable for receipt of said supply of tissues.

9. The dispenser as in claim 8, wherein said supply of tissues are provided in a bag or pouch-like container insertable into said housing.

10. The dispenser as in claim , further comprising a supply of folded tissues disposed within said housing, said housing being a disposable item after depletion of said supply of tissues.

11. A dispenser for storing and dispensing folded tissue sheets, said dispenser adapted for configuration with a roll product dispensing fixture having support arms and spindle recesses defined at ends of the support arms, said dispenser comprising:

a housing having an internal compartment configured to retain a supply of folded issue sheets;

a dispensing opening defined in a wall of said housing:

a slide member movably configured on each of opposite side walls of said housing, said slide member movable between a plurality of operable positions along said side wall;

a protrusion disposed on each of said slide members, said protrusions having a shape and configuration for engagement with the spindle recesses in the fixture support arms; and wherein said housing is adaptable with fixtures having varying length support arms.

12. The dispenser as in claim 11, wherein said slide members are also outwardly adjustable with respect to said side walls.

13. The dispenser as in claim 12, further comprising resiliently biased spring bars disposed on said housing side walls, said slide members mounted on and positionable along said spring bars.

14. The dispenser as in claim 13, further comprising interengaging members disposed between said spring bars and said slide members, said interengaging members releasably locking said slide members in position along said spring bars.

* * * * *